United States Patent [19]

Watanabe

[11] Patent Number: 4,705,394

[45] Date of Patent: Nov. 10, 1987

[54] MULTI-COLOR IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 804,145

[22] Filed: Dec. 3, 1985

[30] Foreign Application Priority Data

Dec. 4, 1984 [JP] Japan ..... 59-256144

[51] Int. Cl.[4] ..... G03G 15/06

[52] U.S. Cl. ..... 355/3 DD; 355/4

[58] Field of Search ..... 355/3 R, 3 DD, 3 DR, 355/4

[56] References Cited

U.S. PATENT DOCUMENTS 3,910,231 10/1975 Inoue et al. ..... 355/4 X
4,097,139 6/1978 Hauser et al. ..... 355/3 DD X
4,523,834 6/1985 Pelda et al. ..... 355/14 D
4,620,783 11/1986 Tanaka et al. ..... 355/14 D

FOREIGN PATENT DOCUMENTS 60-233669 11/1985 Japan ..... 355/4

*Primary Examiner*—Arthur T. Grimley
*Assistant Examiner*—Jane K. Lau
*Attorney, Agent, or Firm*—Oblon, Fisher, Spivak, McClelland & Maier

[57] ABSTRACT

In an image forming apparatus, a first developing device is held by a rockable first holder, and a second developing device is held by a slidable second holder. The first or second developing device can be opposed, alternatively, to an image carrier by sliding the second holder. Thus, developing agents stored individually in the first and second developing devices can be alternatively supplied by use of a simple arrangement.

10 Claims, 13 Drawing Figures

MULTI-COLOR IMAGE FORMING APPARATUS

FIELD OF THE INVENTION

The present invention relates to an image forming apparatus serving as, for example, an electronic copying apparatus, and more specifically to an image forming apparatus provided with a plurality of developing devices and constructed so that a latent image is developed through alternative use of the developing devices.

BACKGROUND OF THE INVENTION

Generally, an electronic copying apparatus has a developing device within its housing. A developing agent is supplied from the developing device to an electrostatic latent image formed on a photosensitive drum, and the latent image is thereby developed. However, electronic copying apparatuses provided with a plurality of developing devices have recently been developed. In copying apparatuses of this type, the developing devices are opposed, alternatively, to a photosensitive drum, and supply the drum with developing agents of different colors for multicolor developing.

These prior art copying apparatuses, however, require a sophisticated selecting mechanism for alternatively opposing the developing devices to the photosensitive drum, resulting in increased size and higher cost.

SUMMARY OF THE INVENTION

The present invention has been contrived in consideration of these circumstances, and is intended to provide an multi-color image forming apparatus in which a plurality of developing devices can be opposed alternatively to an image carrier without requiring a complicated selecting mechanism.

In order to achieve the above object, there is provided an image forming apparatus in which a first developing device is held by a rockable first holder, and a second developing device is held by a slidable second holder. The first or second developing device can be opposed, alternatively, to an image carrier by sliding the second holder. Thus, developing agents stored individually in the first and second developing devices can be alternatively supplied by use of a simple arrangement.

BRIEF DESCRIPTION OF THE DRAWINGS

FIGS. 1 to 11 show a first embodiment of an image forming apparatus according to the present invention, in which:

FIG. 1 is a side view schematically of an electronic copying apparatus;

FIG. 2 is a vertical, sectional view of a developing device;

FIG. 3 is a perspective view of a magnet roller;

FIG. 4 is a perspective view of a mixer;

FIG. 5 is a perspective view of the electronic copying apparatus;

FIGS. 6 and 7 are a perspective view and a side view, respectively, schematically illustrating the manner in which, the developing devices are inserted;

FIG. 8 is a perspective view of first and second holders;

FIG. 9 is a perspective view illustrating the operation of the holders;

FIG. 10 is a side view of the electronic copying apparatus in which the second developing device is opposed to the photosensitive drum;

FIG. 11 is a side view of the electronic copying apparatus in which the first developing device is opposed to the photosensitive drum.

DETAILED DESCRIPTION OF THE PREFERRED EMBODIMENTS

A first embodiment of an electronic copying apparatus according to the present invention and as applied to an electronic copying apparatus will now be described in detail with reference to the accompanying drawings of FIGS. 1 to 11.

Figure 1:
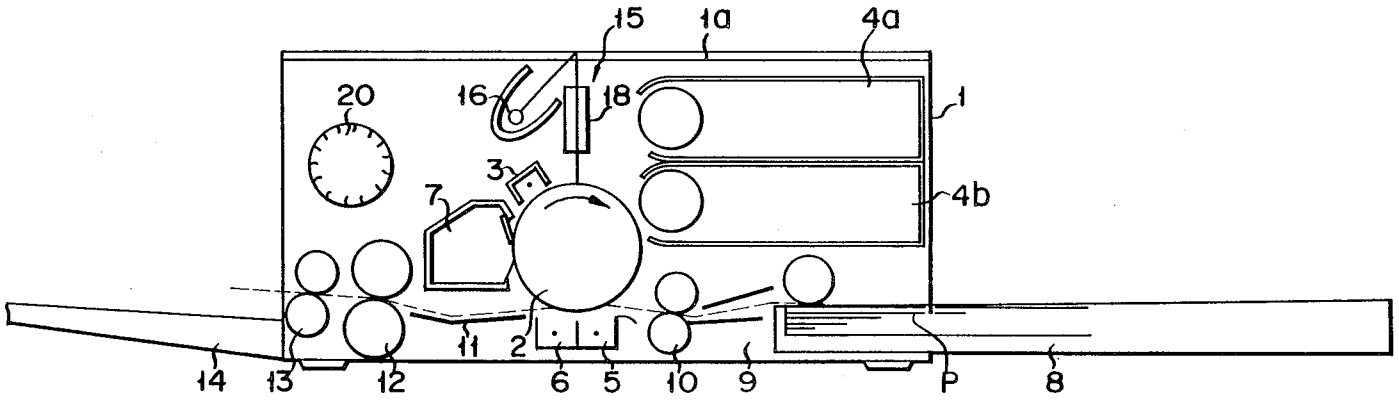

In FIG. 1, numeral 1 designates the housing of the electronic copying apparatus. A photosensitive drum 2, as an image carrier, is disposed in the central portion of the housing 1 so as to be rotatable in the clockwise direction. The photosensitive drum 2 is surrounded by a main charger 3, two developing devices **4*a* and 4*b*, a transfer charger 5, a separation charger 6, and a cleaning unit 7, which are arranged successively in the rotating direction of the drum 2. A sheet cassette 8 is removably attached to the lower portion of the right-hand side of the housing 1. The sheet cassette 8 is designed so as to deliver paper sheets P one at a time. Each delivered sheet P is fed along a transport path 9 inside the housing 1. Aligning rollers 10, the transfer and separation chargers 5 and 6, a guide plate 11, a fixing unit 12, and exit rollers 13 are arranged successively in the feeding direction of the paper sheet P along the transport path 9. A receiving tray 14 is attached to the lower portion of the left-hand side of the housing 1**.

An original table **1*a* is mounted for reciprocal movement on the top of the housing 1. An optical system 15 is provided under the original table 1*a*. The optical system 15 includes a lamp 16, and a lens 18. The image of an original put on the original table 1*a* is projected onto the photosensitive drum 2 by the optical system 15. A cooling fan 20 is disposed over the fixing unit 12 inside the housing 1, so that air in the housing 1** can be exhausted.

Figure 2:
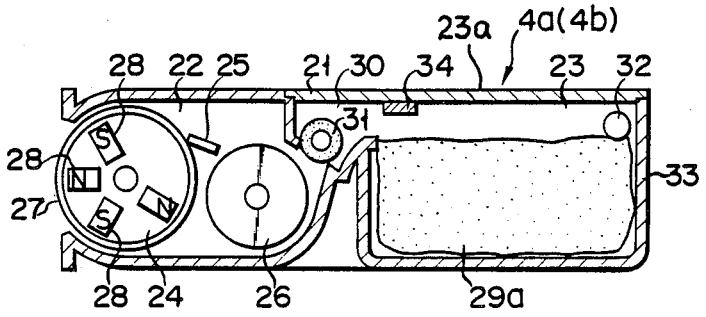
Figure 3:
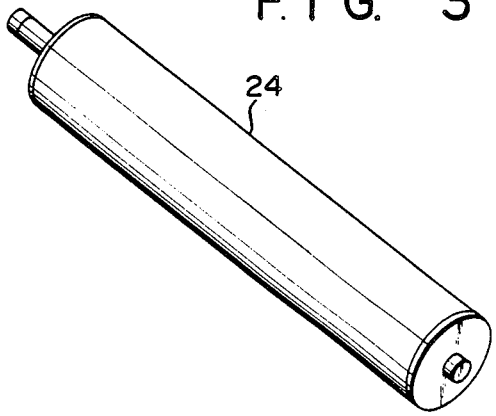
Figure 4:
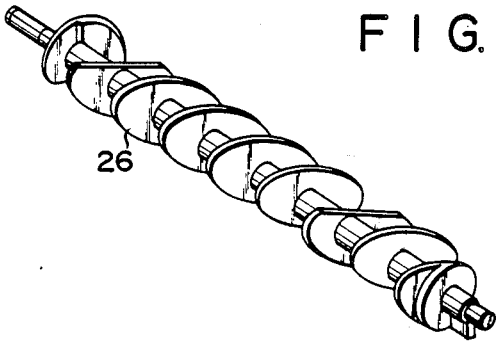
Figure 5:
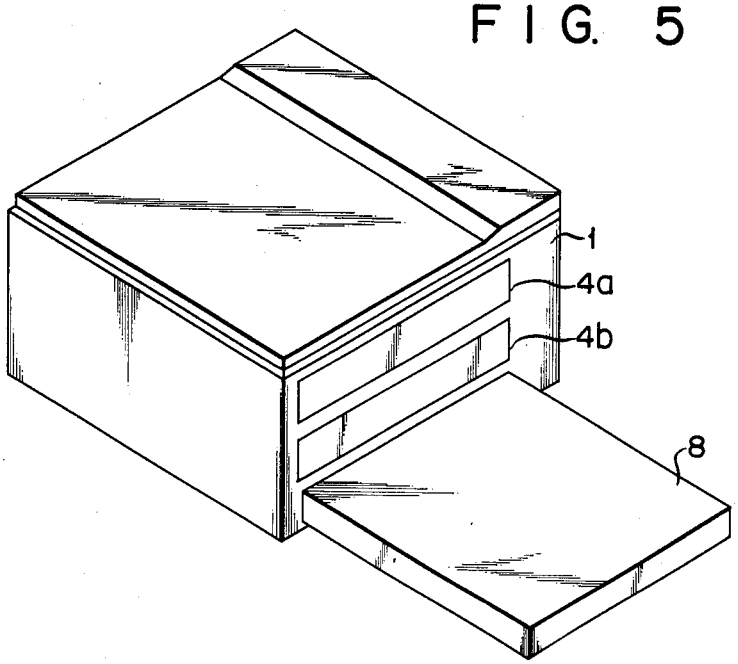
Figure 6:
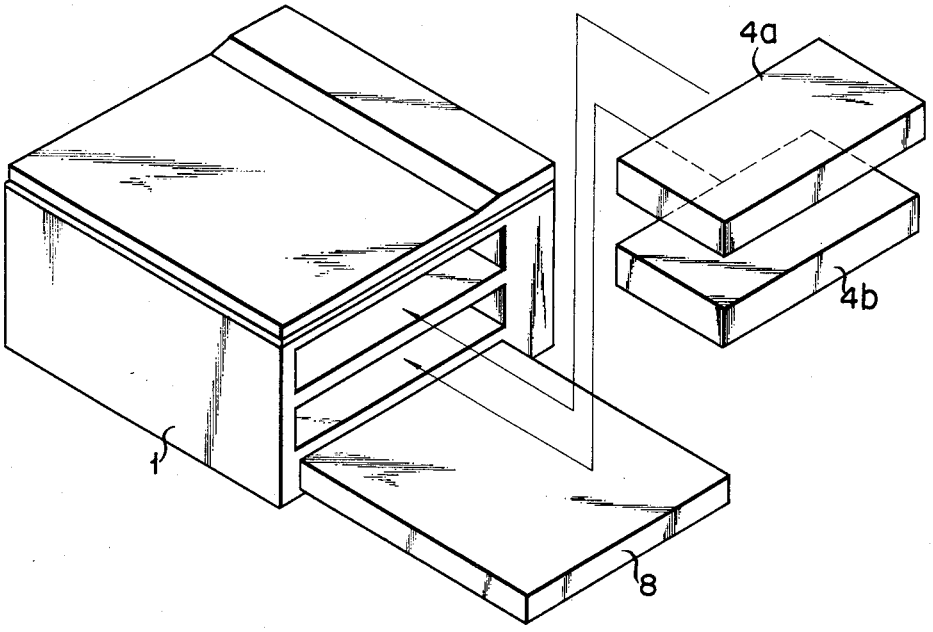

Each of the developing devices **4*a* and 4*b* is constructed as shown in FIG. 2. In FIG. 2, numeral 21 designates a flat developing vessel. A developing chamber 22 of substantially a rectangular shape, and a toner chamber 23, as a developing agent resupply section, are formed integrally with and adjacent to each other in the developing vessel 21. The developing chamber 22 contains a magnet roller 24 (see FIG. 3), a scraper 25, and a mixer 26 (see FIG. 4). The magnet roller 24, which consists of a sleeve 27 and permanent magnets 28 fixedly arranged therein, serves to carry a toner 29 from the developing chamber 22 to the photosensitive drum 2. The scraper 25 serves to scrape off the toner 29 which remains on the sleeve 27 without having been used in the developing process on the photosensitive drum 2. The removed toner 29 is stirred by the mixer 26 to prevent massing. An auxiliary chamber 30 is provided between the upper portions of the developing chamber 22 and the toner chamber 23 so as to connect the same. A resupply roller 31 is disposed in the auxiliary chamber 30 so that the toner 29 in the toner chamber 23 is fed into the developing chamber 22 at a fixed rate as the resupply roller 31** rotates.

Disposed in the toner chamber 23, moreover, is a film 33, as a feed mechanism, one end of which is fixed to the upper edge of the inner wall of the toner chamber 23 on the side of the auxiliary chamber 30, and the other end of which is wound around a shaft 32, as take-up means, provided opposite the auxiliary chamber 30 at the developing vessel 21. The toner 29 is placed on the film 33. As the film 33 is taken up by the rotating shaft 32, therefore, the toner 29 on the film 33 is lifted up and transported into the auxiliary chamber 30.

The opening through which the toner 29 is resupplied is formed in that portion of the developing vessel which corresponds to the top face of the toner chamber 23. A lid 23*a* is attached to the top portion of the developing vessel 21 so that the opening can be opened and closed as required. An ultrasonic sensor 34 is attached to the inside of the lid 23*a*. The ultrasonic sensor 34 detects the presence of the toner 29 in the toner chamber 23. The sensor 34 is adapted to rotate the shaft 32 when it is not in contact with the toner 29, and to deliver a signal for stopping the rotation of the shaft 32 when touched by the toner 29.

Figure 7:
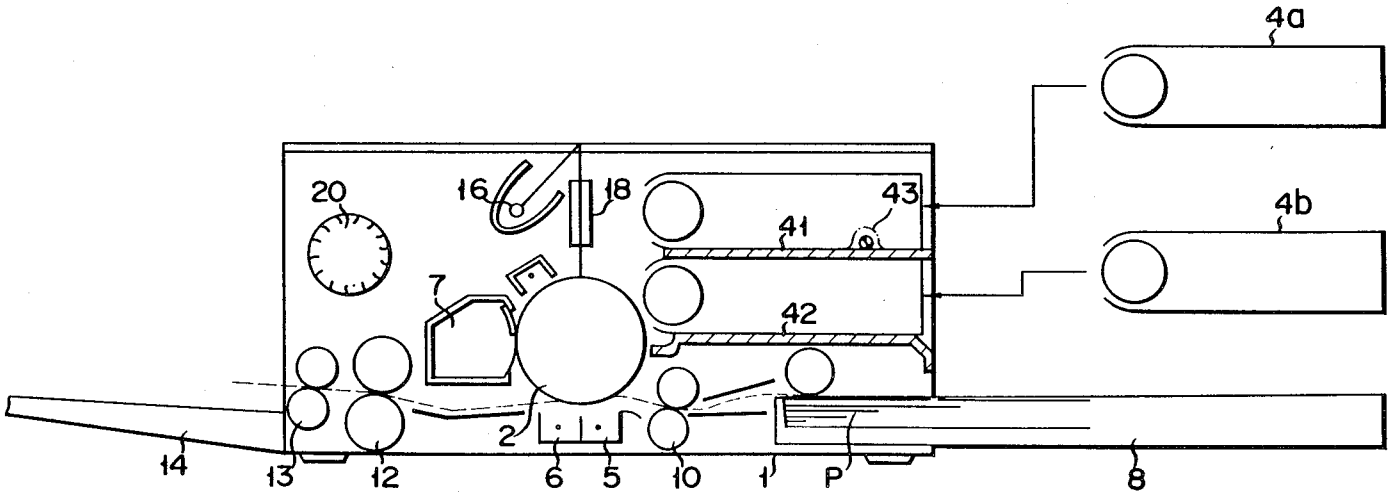
Figure 8:
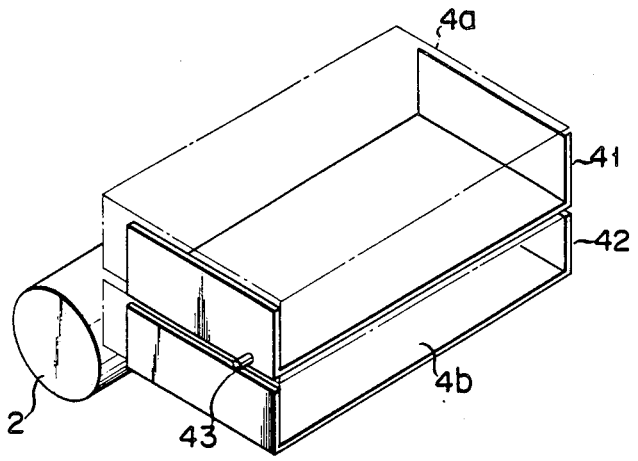
Figure 9:
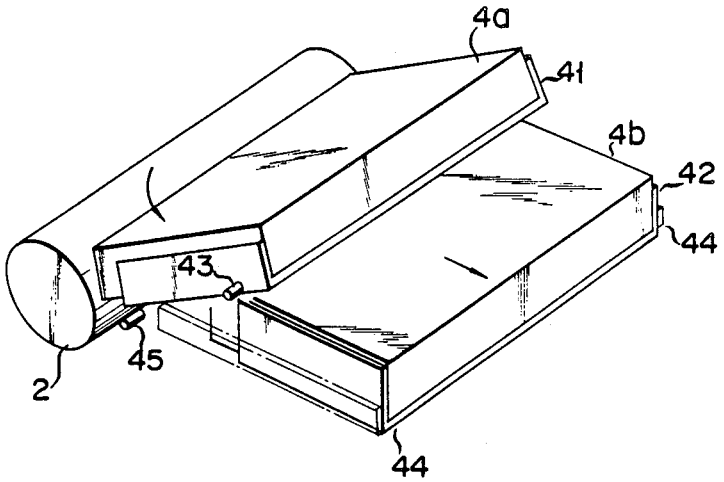
Figure 10:
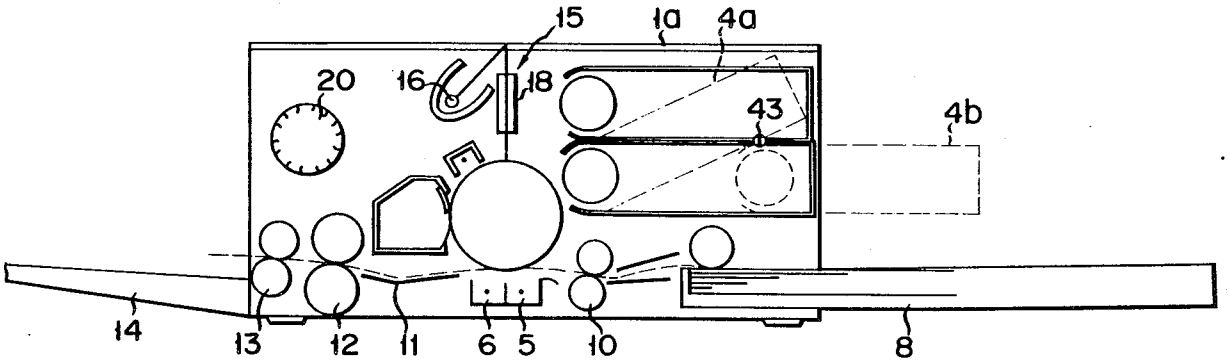
Figure 11:
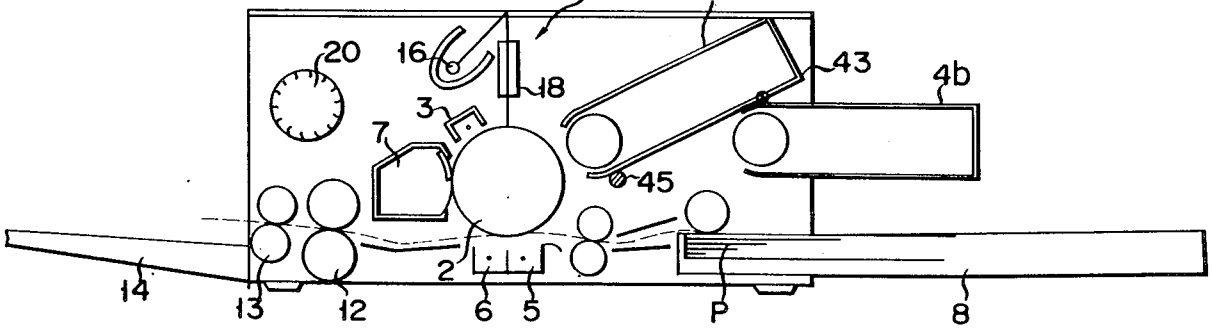

As shown in FIGS. 7 to 9, the first and second developing devices 4*a* and 4*b* are removably held by first and second holders 41 and 42, respectively, which are arranged vertically. The first holder 41 on the upper side is rockably supported on pivot means 43, while the second holder 42, on the lower side, is slidably supported by slider means 44. The first and second developing devices 4*a* and 4*b* are removably loaded into the housing 1, as indicated by arrows in FIG. 6. As the second developing device 4*b* is slid, the first holder 41 is rocked, so that the first and second developing devices 4*a* and 4*b* can be opposed, alternatively, to the photosensitive drum 2.

In a state such that the second developing device 4*b* is not in the second holder 42 or that the former is partially drawn out from the latter (or in a second nondeveloping position), the first holder 41 rocks downward (in the counterclockwise direction of FIG. 9) around the pivot means 43, and abuts against stopper means 45 to be held thereby in position. Thus held in the abutting position, the first holder 41 leads the first developing device 4*a* into the developing position. Meanwhile, when the second developing device 4*b* is inserted into the innermost part of the second holder 42 and carried on the slider means 44, the first holder 41 is forced upward. As a result, the first developing device 4*a* is moved from the developing position into the first nondeveloping position, and the second developing device 4*b* is brought into the developing position in its place.

In forming an image in the electronic copying apparatus constructed in this manner, the original on the original table 1*a* is scanned with a light beam applied by the optical system 15, and the light reflected from the original is projected onto the photosensitive drum 2 through the the lens 18, forming an electrostatic latent image on the drum 2. The electrostatic latent image is supplied with a toner 29*a* or 29*b* from either the first or second developing device 4*a* or 4*b*, and is thereby developed into a visible image. When the first and second developing devices 4*a* and 4*b* are in the positions indicated by the line in FIG. 10, the second developing device 4*b* is held in the developing position, where it supplies the toner 29*b*. If the second developing device 4*b* is slidingly drawn out to the position shown in FIG. 11, the first developing device 4*a* rocks around the pivot means 43, and it stops when its lowered end abuts against the stopper means 45. Thus, the first developing device 4*a* is located in the developing position where it faces the photosensitive drum 2 and supplies the toner 29*a* thereto. When the second developing device 4*b* is thereafter inserted into the second holder, the first developing device 4*a* is rocked upward to allow the second developing device 4*b* to face the photosensitive drum 2 again.

Meanwhile, the developed image is transferred to the paper sheet P from the sheet cassette 8 by the transfer charger 5. Thereafter, the paper sheet P is separated from the photosensitive drum 2 by the separation charger 6, and then fed along the guide plate 11 to the fixing unit 12. After the image is fixed by the fixing unit 12, the paper sheet P is discharged into the receiving tray 14 by the exit rollers 13.

According to this embodiment, as described above, the first or second developing device 4*a* or 4*b* can be alternatively located to face the photosensitive drum 2 in the developing position by sliding the lower or second developing device 4*b*. It is, therefore, possible to alternatively supply the toner 29*a* or 29*b* from the first or second developing device 4*a* or 4*b* without need of a complicated selecting mechanism.

Figure 12:
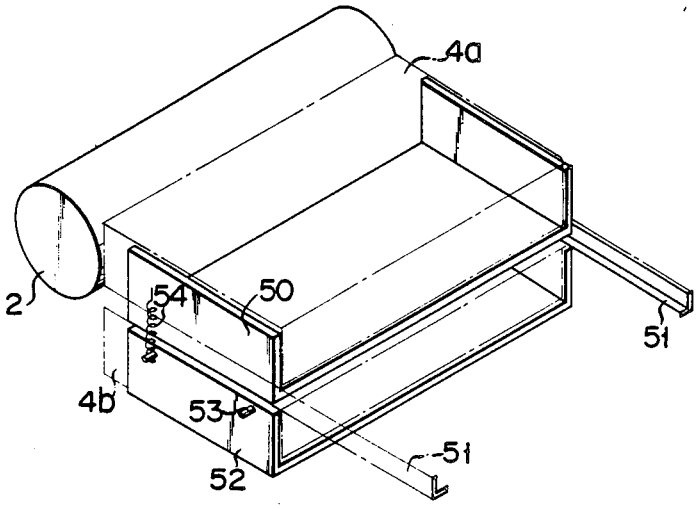
FIGS. 12 and 13 are side views schematically illustrating a second embodiment of the image forming apparatus of the invention.
Figure 13:
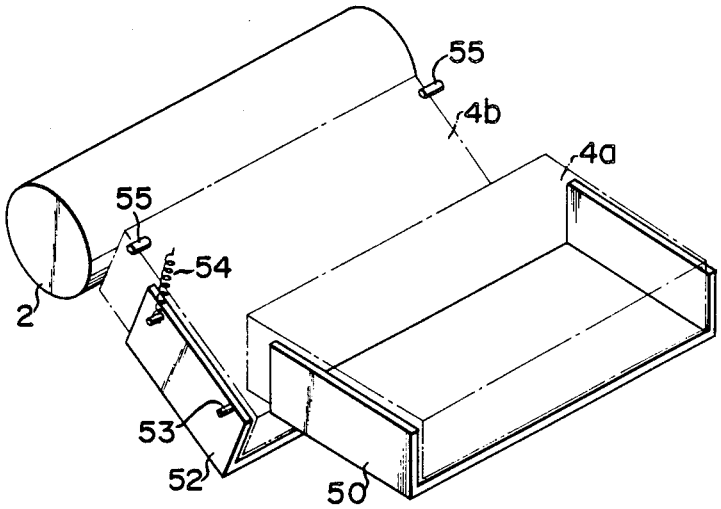

It is to be understood that the present invention is not limited to the above described embodiment, and that various changes and modifications may be effected therein by one skilled in the art without departing from the scope or spirit of the invention. In the above embodiment, for example, the upper or first holder 41 is described as being supported rockably, and the lower or second holder 42 as being slidably supported by the slider means 44. Alternatively, however, a first holder 50 on the upper side may be slidably supported by slider means 51, with the second holder 52 on a lower side rockable around pivot means 53, as in a second embodiment shown in FIGS. 12 and 13. In this case, the second holder 52 is urged to rock upward by a spring 54. (Numeral 55 designates members equivalent to the stopper means 45 of the first embodiment.)

According to the second embodiment constructed in this manner, the first or second developing device 4*a* or 4*b* can be located, alternatively, in the developing position by sliding the upper or first developing device 4*a*, thus providing the same effect as in the first embodiment.

What is claimed is:

1. An image forming apparatus comprising:

(a) a housing;

(b) an image carrier disposed in said housing and adapted to have latent images formed on the surface thereof;

(c) firt developing means disposed opposite said image carrier and adapted to apply a first developing agent to said image carrier to thereby develop a latent image formed on the surface of said image carrier, said first developing means being supported so as to be rockable around a pivot means between a developing position and a first nondeveloping position; and (d) second developing means disposed opposite said image carrier so as to adjoin said first developing means in vertical direction, said second developing means being adapted to apply a second developing agent to said image carrier to thereby develop a latent image formed on the surface of said image carrier, said second developing means being movable between a developing position and a second nondeveloping position, said second developing means preventing said first developing means from being rocked from the first nondeveloping position to its developing position when said second developing means is in its developing position, and allowing said first developing means to be rocked from the first nondeveloping position to its developing position when said second developing means is moved to the second nondeveloping position.

2. The image forming apparatus according to claim 1, wherein:

(a) said first developing means includes a first holder rockable around said pivot means and a first developing device removably held by said first holder and containing the first developing agent so that the first developing agent can be applied to said image carrier and (b) said second developing means includes a second holder provided adjacent to said first holder, slider means supporting said second holder for reciprocal movement, and a second developing device removably held by said second holder and containing the second developing agent so that the second developing agent can be applied to said image carrier.

3. The image forming apparatus according to claim 2, wherein said first holder is located above said second holder, so that said first developing device is brought to its developing position by gravity when said second developing device is in the second nondeveloping position and is forced upward into the first non-developing position by said second holder when said developing device is in its developing position.

4. The image forming apparatus according to claim 3 wherein said first and second developing devices are removably attached to said housing.

5. The image forming apparatus according to claim 2, wherein:

(a) said first holder is located below said second holder and (b) said second developing means includes urging means for urging said second holder upward so that said first developing device is brought to its developing position by the urging force of said urging means when said second developing device is in the second nondeveloping position and is forced upward, against the urging force of said urging means, into the first nondeveloping position by said second holder when said second developing device is in its developing position.

6. The image forming apparatus according to claim 5 wherein said first and second developing devices are removably attached to said housing.

7. The image forming apparatus according to claim 1, wherein said pivot means is located at one end of said first developing means.

8. An image forming apparatus comprising:

(a) a housing;

(b) an image carrier disposed in said housing and adapted to have latent images formed on the surface thereof;

(c) first developing means mounted in said housing so as to be rockable between a firt developing position, in which said first developing means is disposed opposite said image carrier and is adapted to apply a first developing agent to said image carrier to thereby develop a latent image formed on the surface of said image carrier, and a first nondeveloping position; and (d) second developing means mounted in said housing so as to be linearly movable between a second developing position, in which said second developiog means is disposed opposite said image carrier and adapted to apply a second developing agent to said image carrier to thereby develop a latent image formed on the surface of said image carrier, and a second nondeveloping position, said second developing means moving said first developing means from the first developing position to the first nondeveloping position when said second developing means is moved from the second nondeveloping position to the second developing position.

9. The image forming apparatus according to claim 8, wherein:

(a) said first developing means has an axis around which said first developiog means is rocked and (b) said second developing means is linearly movable in a direction normal to the axis of said first developing means.

10. The image forming apparatus according to claim 8, wherein said first and second developing means store the first and second developiog agents, respectively.

* * * * *